US007887219B2

(12) United States Patent
Belliveau et al.

(10) Patent No.: US 7,887,219 B2
(45) Date of Patent: Feb. 15, 2011

(54) TWIN BEAM THEATRICAL LIGHT WITH RADIAL LENTICULAR HOMOGENIZING LENS

(75) Inventors: Richard S. Belliveau, Austin, TX (US); Michael Bell, Austin, TX (US); Joe Shelton Williamson, III, Austin, TX (US)

(73) Assignee: Barco Lighting Systems, Inc., Austin, TX (US)

( * ) Notice: Subject to any disclaimer, the term of this patent is extended or adjusted under 35 U.S.C. 154(b) by 369 days.

(21) Appl. No.: 12/256,613

(22) Filed: Oct. 23, 2008

(65) Prior Publication Data

US 2010/0103677 A1 Apr. 29, 2010

(51) Int. Cl.
*F21S 8/00* (2006.01)

(52) U.S. Cl. ..... 362/268; 362/277

(58) Field of Classification Search ..... 362/3, 362/11, 13, 14, 16, 17, 18, 268, 269, 271, 362/272, 275, 277, 281
See application file for complete search history.

(56) References Cited

U.S. PATENT DOCUMENTS 4,392,187 A 7/1983 Bornhorst ..... 362/233
4,972,306 A 11/1990 Bornhorst ..... 362/278
5,608,580 A 3/1997 Quadri ..... 359/831
6,048,080 A 4/2000 Belliveau ..... 362/282
6,502,961 B1 1/2003 Richardson ..... 362/268
2007/0195526 A1 * 8/2007 Dowling et al. ..... 362/234

OTHER PUBLICATIONS

U.S. Appl. No. 11/516,822, filed Sep. 27, 2006, Belliveau.
Altman Stage Lighting 65Q catalog page, Copyright 2003, Altman Lighting Inc.

* cited by examiner

*Primary Examiner*—David V Bruce
(74) *Attorney, Agent, or Firm*—Walter J. Tencza, Jr.

(57) ABSTRACT

A theatre lighting apparatus comprising a base, a communications port, a processor, a memory, and a lamp housing is disclosed. The lamp housing may include a lamp, a reflector, an output lens, a motor, and a homogenizing lens. The homogenizing lens may be comprised of a plurality of radially arranged lenticular lenses. The processor may be programmed to enable a motor to vary a position of the homogenizing lens in relation to a position of the output lens. The homogenizing lens may be comprised of a first half and a second half, each of which may have a plurality of radially arranged lenticular lenses.

25 Claims, 8 Drawing Sheets

TWIN BEAM THEATRICAL LIGHT WITH RADIAL LENTICULAR HOMOGENIZING LENS

FIELD OF THE INVENTION

This invention relates to multiparameter lighting fixtures.

BACKGROUND OF THE INVENTION

Multiparameter lighting fixtures are lighting fixtures, which illustratively have two or more individually remotely adjustable parameters such as focus, color, image, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks. Illustrative multi-parameter lighting fixtures are described in the product brochure showing the High End Systems product line for the year 2000 and are available from High End Systems, Inc. of Austin, Tex.

Multiparameter lighting fixtures are commonly constructed with a lamp housing that may pan and tilt in relation to a base housing so that light projected from the lamp housing can be remotely positioned to project on the stage surface. Commonly a plurality of multiparameter lights are controlled by an operator from a central controller. The central controller is connected to communicate with the plurality of multiparameter lights via a communication system. U.S. Pat. No. 4,392,182 titled "Computer controlled lighting system having automatically variable position, color, intensity and beam divergence" to Bornhorst and incorporated herein by reference, disclosed a plurality of multiparameter lights and a central controller.

The lamp housing of the multiparameter light contains the optical components and the lamp. The lamp housing is rotatably mounted to a yoke that provides for a tilting action of the lamp housing in relation to the yoke. The lamp housing is tilted in relation to the yoke by a motor actuator system that provides remote control of the tilting action by the central controller. The yoke is rotatably connected to the base housing that provides for a panning action of the yoke in relation to the base housing. The yoke is panned in relation to the base housing by a motor actuator system that provides remote control of the panning action by the central controller.

A lamp and reflector are used in combination to produce a light path for a theatrical light. It is desirable to have a field of light produced by the theatrical light that does not have artifacts from the lamp image in the projected light. Various means to reduce artifacts in the prior art include facets placed into the reflector, diffusion glass placed into the light path and fly's eye homogenizing lenses. For example the present inventor discloses in U.S. Pat. No. 6,048,080 to Belliveau a lenticular array of lens elements for variably shaping a beam of a theatrical light. The Bornhorst '182 patent previously mentioned above discloses an integrating lens 100 formed of a large number of small spherical lens 102 mounted on a flat transparent substrate which acts to homogenize light.

The present inventor's pending patent application Ser. No. 11/516,822, filed on Sep. 7, 2006 discloses a multiparameter theatrical light that incorporates a polymer fresnel output lens to reduce lens weight. This type of lens uses micro lenslets to form the optical power of the lens. Because of the size and frequency of the micro lenslets the polymer fresnel lens is quite transparent to the eye. When a fly's eye homogenizing lens (such as the integrating lens 100 of U.S. patent to Bornhorst '182) is placed in a light path of a theatrical light incorporating a polymer fresnel output lens in the location before the polymer fresnel lens, the honeycomb pattern of a fly's eye homogenizing lens can be easily seen from the outside of the theatrical light. Most prior art theatrical spotlights employ radially designed glass Fresnel lenses as output lenses. An example of this incorporated herein is the Altman 65Q catalog page from Altman Stage Lighting of Yonkers, N.Y.

It is desirable during the presentation of a theatrical light incorporating a polymer fresnel lens to avoid displaying a honeycomb pattern from a fly's eye homogenizing lens as seen through the polymer Fresnel lens. It is desirable to construct a homogenizing lens that does an excellent job of homogenizing while still retaining a radial like visible pattern created by the homogenizing lens.

Effects using various prism types have been used in the prior art with automated theatrical lights. Prism effects can increase the value of an automated theatrical light by augmenting the image varying capability of the light. It would be therefore be desirable to create a new prism effect for an automated theatrical light that has a new dynamic look that can be adjusted by an operator of the theatrical light.

SUMMARY OF THE INVENTION

One or more embodiments of the present invention provide a theatre lighting apparatus comprising a base, a communications port, a processor, a memory, and a lamp housing. The lamp housing may include or have located therein a lamp, a reflector, an output lens, a motor, and a homogenizing lens. The homogenizing lens may be comprised of a plurality of radially arranged lenticular lenses. The processor may be programmed to enable a motor to vary a position of the homogenizing lens in relation to a position of the output lens. In at least one embodiment, the communications port receives a command, provides it to the processor, and the processor in response to the command is programmed to cause the motor to vary the position of the homogenizing lens in relation to the position of the output lens. The output lens may be a polymer fresnel lens.

In at least one embodiment, a light path may be created by the lamp and the reflector. The homogenizing lens may be comprised of a first half and a second half, such that the first half is independent of the second half. Each of the first half and the second half may have a plurality of radially arranged lenticular lenses. The processor may be programmed to cause a first motor to tilt the first half in or out of the light path. The processor may be programmed to cause a second motor to tilt the second half in or out of the light path. The processor may be programmed to cause the first motor to tilt the first half into the light path in response to a first command received by the communications port and provided to the processor. The processor may be programmed to cause a motor to vary a position of the homogenizing lens in relation to the reflector.

In one or more embodiments a prism apparatus may be provided. A first light path having an optic axis may be created by the lamp and the reflector. The prism apparatus may be comprised of a plurality of substantially parallel linear triangular prisms. Each of the plurality of prisms has a first side for receiving light from the first light path, a second side for exiting refracted light received from the first light path towards a first direction forming a second light path, and a third side for exiting refracted light received from the first light path towards a second direction forming a third light path. The first direction and the second light path may be at a substantially negative deviation angle in relation to the axis of the first light path and the second direction and third light path may be at a substantially positive deviation angle in relation to the axis of the first light path.

The processor may be programmed to cause a motor to position the prism apparatus to a first position in relation to the output lens along the first light path to obtain a first deviation angle for the second light path and obtain a second deviation angle for the third light path. The processor may be programmed to cause the motor to position the prism apparatus to a second position in relation to the output lens along the first light path to obtain a third deviation angle for the second light path and obtain a fourth deviation angle for the third light path.

The deviation angles of the second light path and the third light path may be remotely controlled by a command received by the communications port and provided to the processor.

The prism apparatus may be comprised of a plurality of Isosceles prisms. The processor may be programmed to cause the motor to rotate the prism apparatus about the axis of the prism apparatus in response to a command received by the communication port and provided to the processor. The processor may be programmed to cause the motor to position the prism apparatus in relationship to the output lens along the first light path in response to a command received by the communication port and provided to the processor.

DETAILED DESCRIPTION OF THE DRAWINGS

Figure 1:
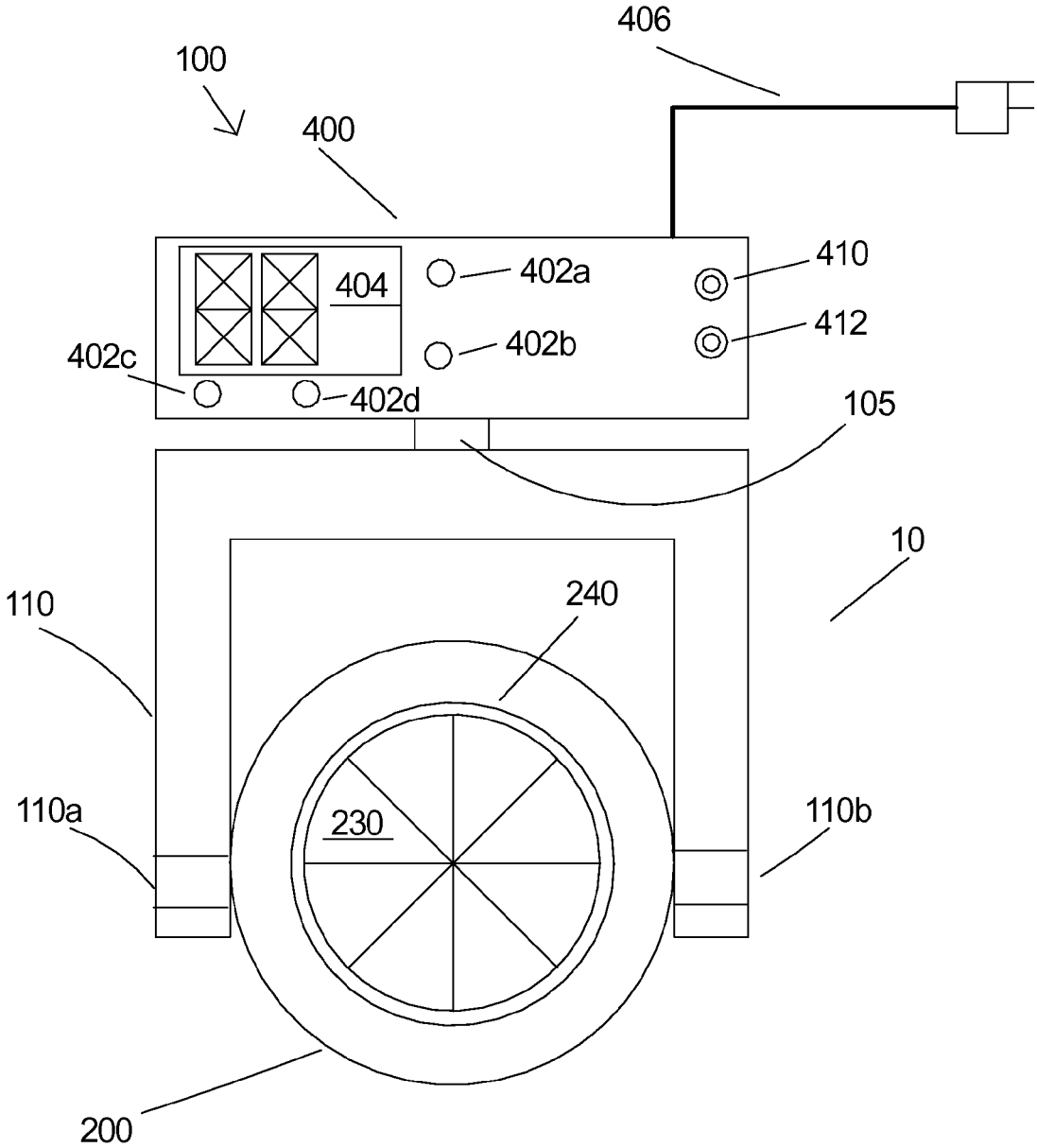
FIG. 1 shows a front view of a theatrical light in accordance with an embodiment of the present invention.

In the description that follows, like parts are marked throughout the specification and drawings with the same reference numerals, respectively. The drawing figures are not necessarily to scale. Certain features of embodiments of the present invention may be shown exaggerated in scale or in somewhat schematic form and some details of conventional elements may not be shown in the interest of clarity and conciseness. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce the desired results.

FIG. 1 shows a front view of a theatrical light, theatre light, or theatre lighting apparatus 100 in accordance with an embodiment of the present invention. The theatrical light 100 may be a multiparameter lighting device. The theatrical light 100 includes a lamp housing 300 and a base housing 400. The theatrical light 100 is capable of remotely panning and tilting the lamp housing 300 in relation to the base housing 400. The lamp housing 300 is mounted by bearing assemblies 110*a* and 110*b* so that the lamp housing 300 can tilt in relation to a yoke 110. The yoke 110 can pan in relation to the base housing 400 by means of a bearing 105. The lamp housing 300 is remotely tilted in relation to the base housing 400 by a first motor actuator not shown for simplicity. The yoke 110 is remotely panned in relation to the base housing 400 by a second motor actuator not shown for simplicity.

The lamp housing 300 includes, or has located therein, an output lens 340. The output lens 340 may be a polymer fresnel lens and typically is the main output lens of the lamp housing 300. The polymer Fresnel lens 340 is optically transparent to the eye. A radial lenticular homogenizing lens 330 as described by FIG. 2A is viewable through the optically transparent polymer Fresnel lens 340.

The base housing 400 has a graphical display 404 and input keys 402*a*, 402*b*, 402*c* and 402*d* used for setting a communications address as well as controlling other functions of the theatrical light 100. The theatrical light 100 also includes a power input cord 406 for connecting the theatrical light 100 to a source of power. The theatrical light 100 also includes connection points 410 and 412, one of which is an input connector and one of which is an output connector.

Figure 2A:
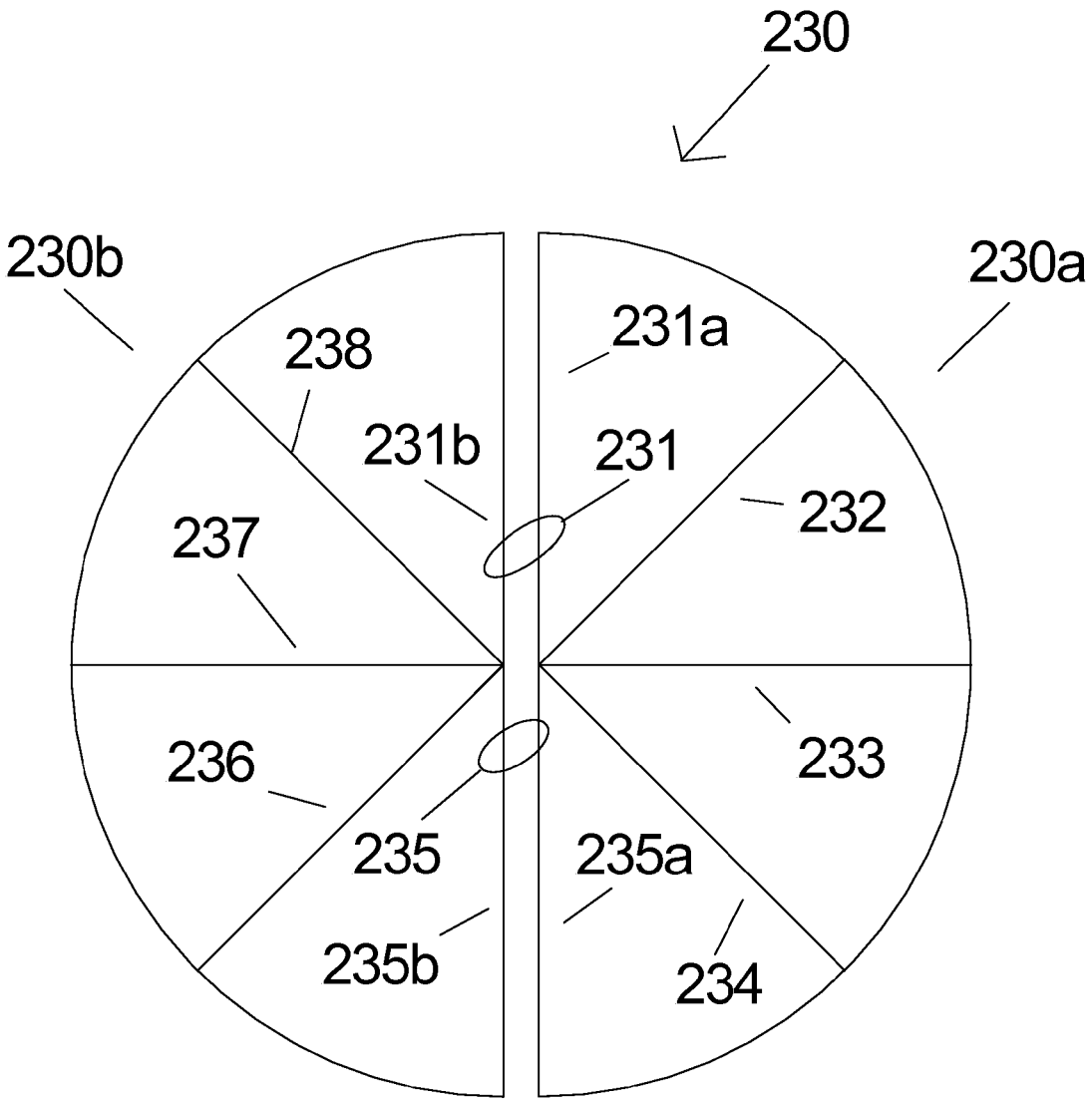
FIG. 2A shows a front view of a radial lenticular homogenizing lens of an embodiment of the present invention.

FIG. 2A shows a detailed drawing of a front view of the radial lenticular homogenizing lens 230. The radial lenticular lens 230 is shown as two half sections 230*a* and 230*b* however the radial lenticular lens 230 may be a single lens without the splitting of the two sides. The radial lenticular lens 230, as shown in FIG. 2A includes eight lenticular lenses or lens sections 231, 232, 233, 234, 235, 236, 237 and 238 arranged in a radial pattern. Each lenticular lens of lenses 231-238, is a section or pie slice of the overall substantially circular radial lenticular lens 230. In FIG. 2A, the lead lines from the numbers 231-238 point to lines which represent apexes of the lenticular lenses 231-238, respectively.

While eight lenticular lenses or sections 231-238 are shown to construct radial lenticular lens 230 more or less lenticular lens sections or elements may be used to form the radial lenticular homogenizing lens 230. Lenticular lens or section 231 is actually bisected into two halves to accommodate the splitting of the lens 230 into half sections 230*a* and 230*b* and the bisection lines are shown as lines 231*a* and 231*b*. Lenticular lens 235 is actually bisected into two halves to accommodate the splitting of the lens 230 into half sections 230*a* and 230*b* and the bisection lines are shown as lines 235*a* and 235*b*. Because each of the eight lenticular lenses or lens sections 231-238 of the radial lenticular homogenizing lens 230 have an optical power, the radial lenticular lens 230 has an overall homogenized optical power. Because the radial lenticular lens 230 has an optical power it can be remotely positioned in relation to the polymer Fresnel output lens 240 shown in FIG. 1 to provide a controllable zoom for the theatrical light 100 of FIG. 1.

Figure 2B:
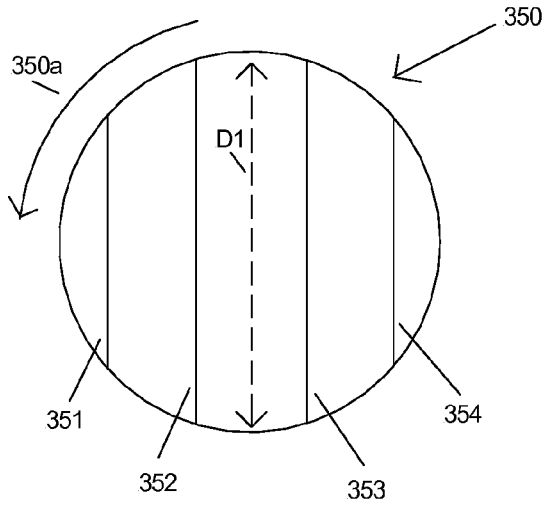
FIG. 2B shows a front view of a prism apparatus of an embodiment of the present invention.

FIG. 2B shows a front view of a prism apparatus 350 that is constructed of linear isosceles prisms 351, 352, 353 and 354 that run parallel to each other. Arrow 350*a* shows that the prism apparatus 350 can also be rotated in a direction about its center by a motor when used as a component of the theatrical light 100.

Figure 2C:
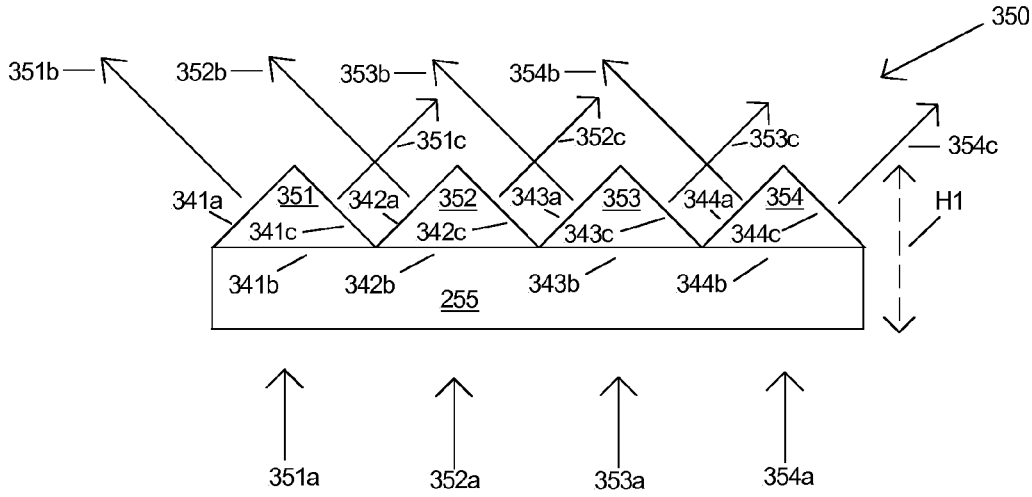
FIG. 2C shows a side view of the prism apparatus of FIG. 2B.

FIG. 2C shows a side view of the prism apparatus 350. The prism apparatus 350 may be constructed of the plurality of prisms 351, 352, 353, and 354, mounted to a substrate 355 or the plurality of prisms 351-354 and the substrate 355 may be molded together to form the prism apparatus 350. It is preferred that the prism apparatus 350 be molded as one overall component. In operation incoming light rays shown as arrow 351*a* passes thought the substrate 355 and through the base 341*b* of the prism 351 where a first portion of light rays 351*a* is refracted into a first direction shown by arrow 351*b* exiting from side 341*a* and a second portion of light rays 351*a* is refracted into a second direction shown by arrow 351*c* exiting from side 341*c*. Light rays shown as arrow 352*a* passes thought the substrate 355 and through the base 342*b* of the prism 352 where a first portion of light rays 352*a* is refracted into a first direction shown by arrow 352*b* exiting from side 342*a* and a second portion of light rays 352*a* is refracted into a second direction shown by arrow 352*c* exiting from side 342*c*. Light rays shown as arrow 353*a* passes thought the substrate 355 and through the base 343*b* of the prism 353 where a first portion of light rays 353*a* is refracted into a first direction shown by arrow 353*b* exiting from side 343*a* and a second portion of light rays 353*a* is refracted into a second direction shown by arrow 353*c* exiting from side 343*c*. Light rays shown as arrow 354*a* passes thought the substrate 355 and through the base 344*b* of the prism 354 where a first portion of light rays 354*a* is refracted into a first direction shown by arrow 354*b* exiting from side 344*a* and a second portion of light rays 354*a* is refracted into a second direction shown by arrow 354*c* exiting from side 344*c*. Isosceles prisms are used with prism apparatus 350 because it is preferred that the rays exiting the prism apparatus 350 exit in two equal but opposite angles. However a prism beam splitting assembly can be produced with exiting angles are not equal and therefore prisms that are not of the isosceles type.

In FIG. 2B, the lead lines from the numbers 351-354 point to vertical lines which represent the apexes of the prisms 351-354, respectively. In FIG. 2C the apexes of the prisms 351-354 are at the top of the prisms 351-354.

The prism apparatus 350 of FIG. 2B in practice can have a diameter D1 which may be three inches. One or more embodiments of the present invention allow the overall height, H1, shown in FIG. 2C of the prism apparatus 350 to be reduced as greater numbers of individual linear prisms are placed together. The prism apparatus 350 may be comprised of any number of linear prisms similar to linear prisms 351-354.

Figure 3A:
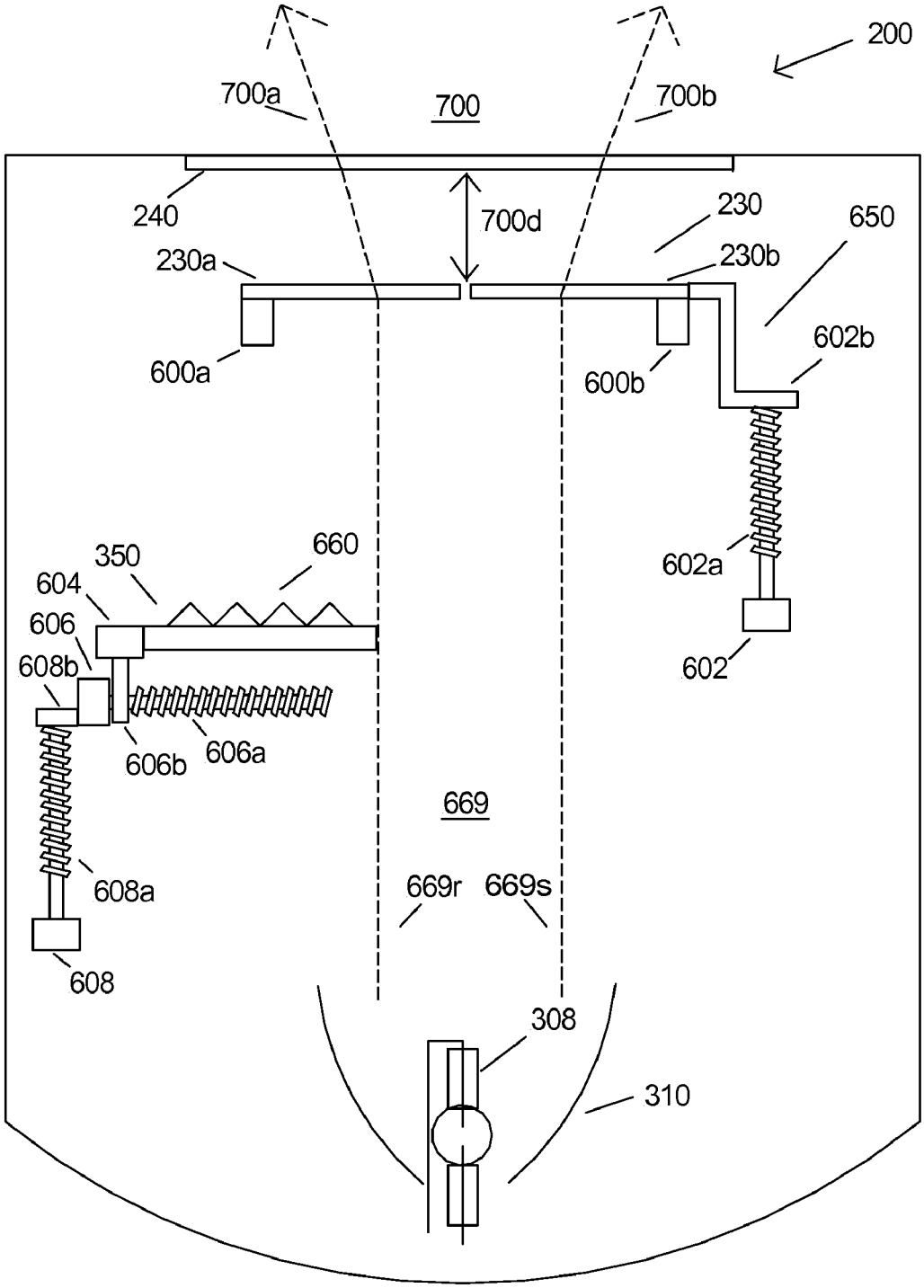
FIG. 3A shows an internal view of components of a lamp housing of the theatrical light of FIG. 1 incorporating the radial lenticular homogenizing lens of FIG. 2A in a first state and the prism apparatus of FIG. 2B in a first state.

FIG. 3A shows internal components of the lamp housing 200 of FIG. 1. A polymer Fresnel output lens 240 is shown. The radial lenticular lens 230 is shown divided into the two half sections 230*a* and 230*b*. A motor 600*a* is attached to pivot the radical lenticular lens half 230*a* and motor 600*b* is shown for pivoting radial lenticular lens half 230*b*. A motor 602 controls the placement of the radial lenticular lens 230 in relation to the output lens 240 by way of a lead screw 602*a* and attachment bracket 602*b*. The radial lenticular lens system 650 which may be comprised of components 230, 230*a*, 230*b*, 600*a*, 600*b*, 602*b*, 602*a* and 602 is shown in a first state. The prism apparatus 350 is shown attached to a rotation motor 604. The rotation motor 604 is capable of rotating the prism apparatus 350 about its center as show by 350*a* of FIG. 2B. The prism apparatus 350 and motor 604 of FIG. 3A are attached to lead screw bracket 606*b*, lead screw 606*a* and driving motor 606 so the prism apparatus 350 can be transitioned into a light path 669 formed delimited by arrows 669*r* and 669*s*, the light of the light path 669 created by a lamp 308 and a reflector 310. The combination of the radial lenticular lens 330 and the polymer fresnel lens 240 at distance shown by arrows 700*d* results in an exiting light path 700 as shown by arrows 700*a* and 700*b*. Driving motor 606 is also connected to lead screw bracket 608*b*, lead screw 608*a* and motor 608 for placement of the prism apparatus 350 in relation to the output lens 340.

Prism apparatus 350, motor 604, bracket 606*b*, lead screw 606*a*, motor 606, bracket 608*b*, lead screw 608*a* and motor 608 are shown in a first state 660 in relation to the light path 669.

Figure 3B:
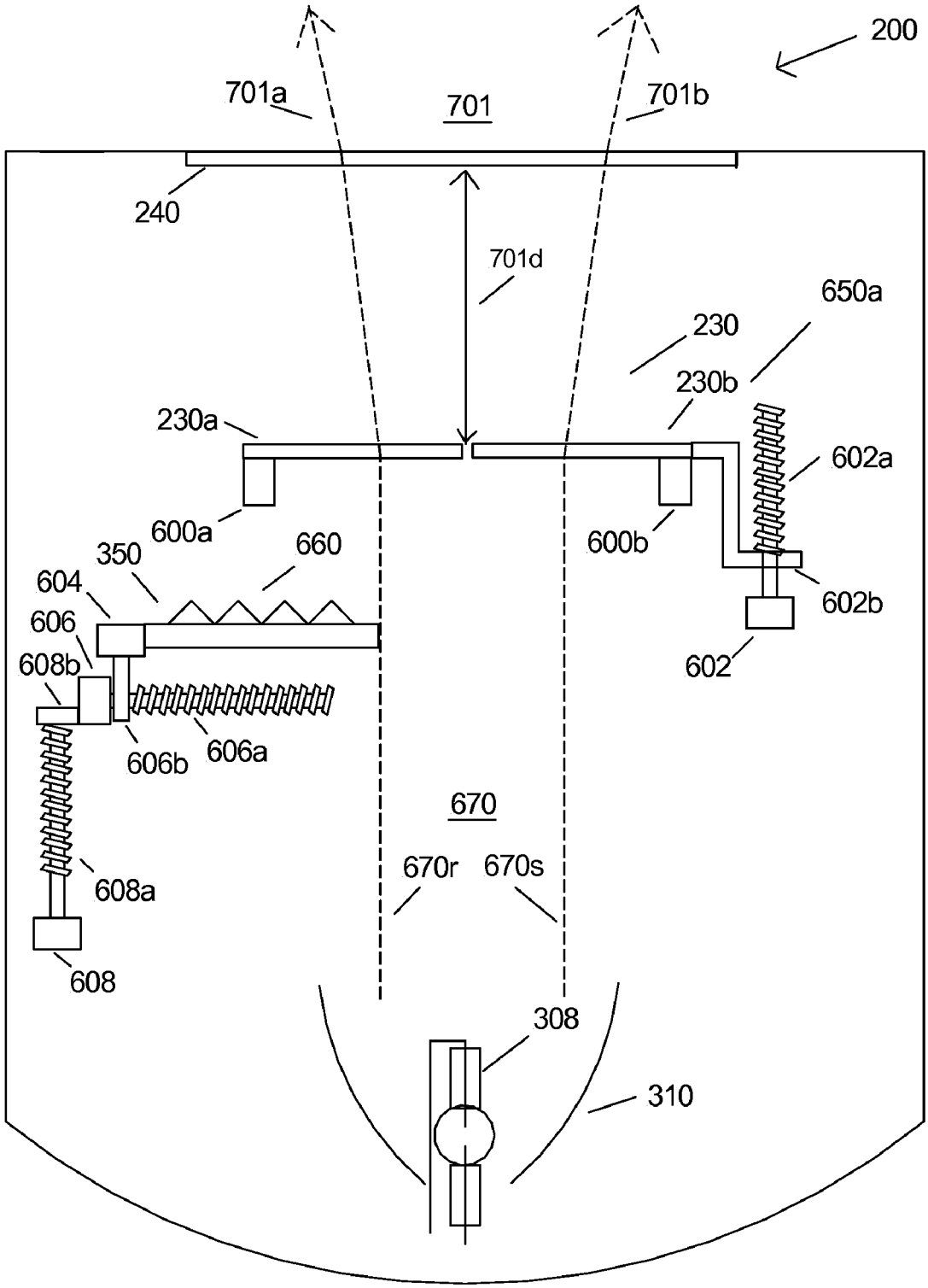
FIG. 3B shows an internal view of the components of the lamp housing of the theatrical light of FIG. 1 incorporating the radial lenticular homogenizing lens of FIG. 2A in a second state and the prism apparatus of FIG. 2B in a first state.

FIG. 3B shows internal components of the lamp housing 200 of FIG. 1. The radial lenticular lens system 650*a* may be comprised of components 230, 230*a*, 230*b*, 600*a*, 600*b*, 602*b*, 602*a* and 602, and the radial lenticular lens system 650*a* is shown in a second state. Driving motor 602 has operated the lead screw 602*a* to move the bracket 602*b* and the radial lenticular lens system 230 to a distance further from the polymer output lens 240 as shown by arrows 701*d*. The combination of the radial lenticular lens 230 and the polymer fresnel lens 240 at the distance shown by arrows 701*d* results in exiting light path 701 as shown by arrows 701*a* and 701*b*. The exiting light path 701 of FIG. 3B is at a narrower angle than the exiting light path 700 of FIG. 3A. Changing the distance between the radial lenticular lens 230 in relation to the polymer Fresnel lens 240 shown as arrows 701*d* results in a change of the exiting light path angle which can also be called a zoom control of the exiting light path. As shown changing the distance between the radial lenticular lens 230 in relation to the polymer Fresnel lens 240 also changes the distance relationship of the radial lenticular lens 230 in relation to the reflector 310.

Figure 3C:
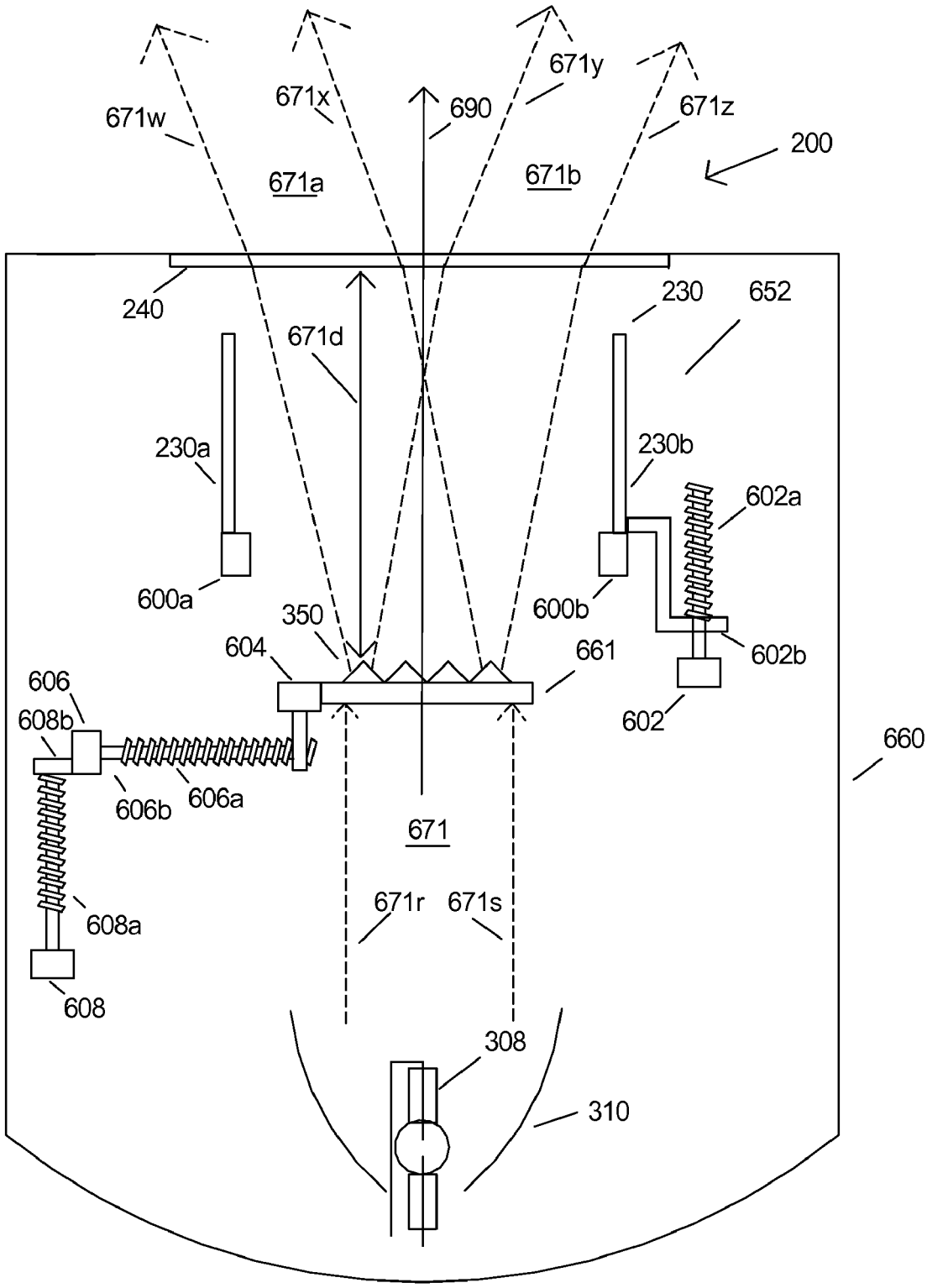
FIG. 3C shows an internal view of the components of the lamp housing of the theatrical light of FIG. 1 incorporating the radial lenticular homogenizing lens of FIG. 2A in a third state and showing the prism apparatus of FIG. 2B in a second state.

FIG. 3C shows the radial lenticular lens 230 in a third state 652. The radial lenticular lens system 230 has had each half section 230*a* and 230*b* tilted out of the second light path 671*a* and the third light path 671*b* by corresponding motors 230*a* and 230*b*. Second light path 671*a* is shown by arrows 671*w* and 671*x* and third light path 671*b* is shown by arrows 671*y* and 671*z*. The prism apparatus 350 has been positioned into the first light path 671 at a distance 671*d* from the polymer Fresnel lens 240 by motor 606, lead screw 606*a* and bracket 606*b*. First light path 671 is shown by arrows 671*r* and 671*s*. Arrow 690 represents the center axis of the first light path 671 created by the lamp 308 and the reflector 310. Light from the first light path 671 enters the prism apparatus 350 and exits the prism apparatus 350 as a second light path 671*a* and a third light path 671*b*. Second light path 671*a* exits the theatrical light 100 in a negative angular deviation in relation to 690 and third light path 671*b* exits the theatrical light 100 in a positive angular deviation in relation to the center axis 690 of the first light path 671.

Prism apparatus 350, motor 604, bracket 606*b*, lead screw 606*a*, motor 606, bracket 608*b*, lead screw 608*a* and motor 608 are shown in a second state 661 of FIG. 3C with prism apparatus 350 positioned in the light path 671. This second state 661 differs from the first state 660 shown in FIG. 3B where the prism apparatus 350 is positioned out of the light path 670.

Figure 3D:
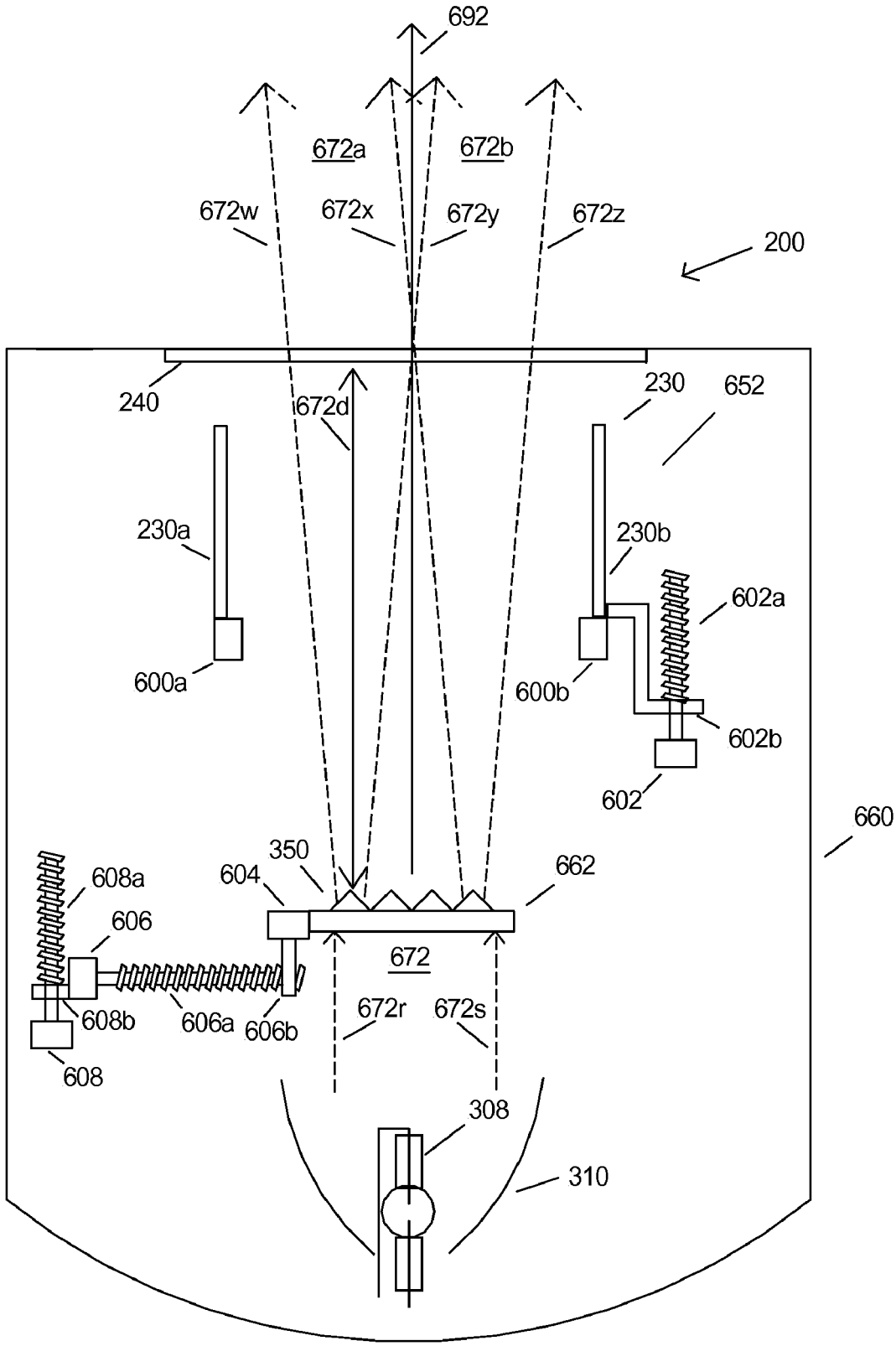
FIG. 3D shows an internal view of the components of the lamp housing of the theatrical light of FIG. 1 incorporating the radial lenticular homogenizing lens of FIG. 2A in a third state and showing the prism apparatus of FIG. 2B in a third state.

FIG. 3D shows the radial lenticular lens 230 in a third state 652 the same as in FIG. 3C. The prism apparatus 350 of FIG. 3D is now shown in a third state 662. The prism lens 350 has been positioned further away at a distance 672*d* from the polymer fresnel lens 240 by motor 608, lead screw 608*a* and bracket 608*b*. First light path 672 is formed by the lamp 308 and the reflector 310. The first light path 672 is shown by arrows 672*r* and 672*s*.

Arrow 692 represents the center axis of the first light path 672. Light from the first light path 672 enters the prism apparatus 350 and exits the prism apparatus 350 as a second light path 672*a* and a third light path 672*b*. Second light path 672*a* exits the theatrical light 100 in a negative angular deviation in relation to the center axis 692 of the first light path 672 and the third light path 672*b* exits the theatrical light 100 in a positive angular deviation in relation to the center axis 692.

With the prism apparatus 350 of FIG. 3D positioned further away by the distance shown as 672*d* from the polymer fresnel lens 240 the angular deviation of the second light path 672*a* and the third light path 672*b* in relation to the center axis 692 of the first light path 672 of FIG. 3D is less angular deviation than the angular deviation of the second light path 671*a* and the third light path 671*b* in relation to the center axis 690 of FIG. 3C. As can be seen by FIGS. 3C and 3D when the prism apparatus 350 is positioned closer to the polymer Fresnel lens 240 the angular deviation of the second and third light paths that exit the polymer Fresnel lens 240 is increased. When the prism apparatus 350 is positioned further away from the polymer Fresnel lens 240 the angular deviation of the second and third light paths that exit the polymer Fresnel lens 240 decreases. The produces a very desirable effect for the theatrical light 100 as an operator remotely controlling the theatrical light 100 of the invention can send a first command to produce two substantially separate exiting beams of light (referred to as twin beams) and also send a second command to control the angular deviation of the two separate beams of light. As explained above the motor 604 can rotate the prism apparatus 350, such as in the direction 350*a* shown in FIG. 2B while the prism apparatus 350 is positioned in the path of the light created by the lamp 308 and the reflector 310. A third command send over a communication system and received by the communications port 460 via the input connection point 410 of the theatrical light 100 can cause the prism apparatus 350 to rotate in a way as shown by arrow 350*a* of FIG. 2A. In this way the two twin beams of light can have both angular deviation and rotation remotely controlled. The command sent by the operator of a remote control console and received by the communications port 460 of FIG. 4 can be compatible with the known DMX theatrical communications protocol.

Figure 4:
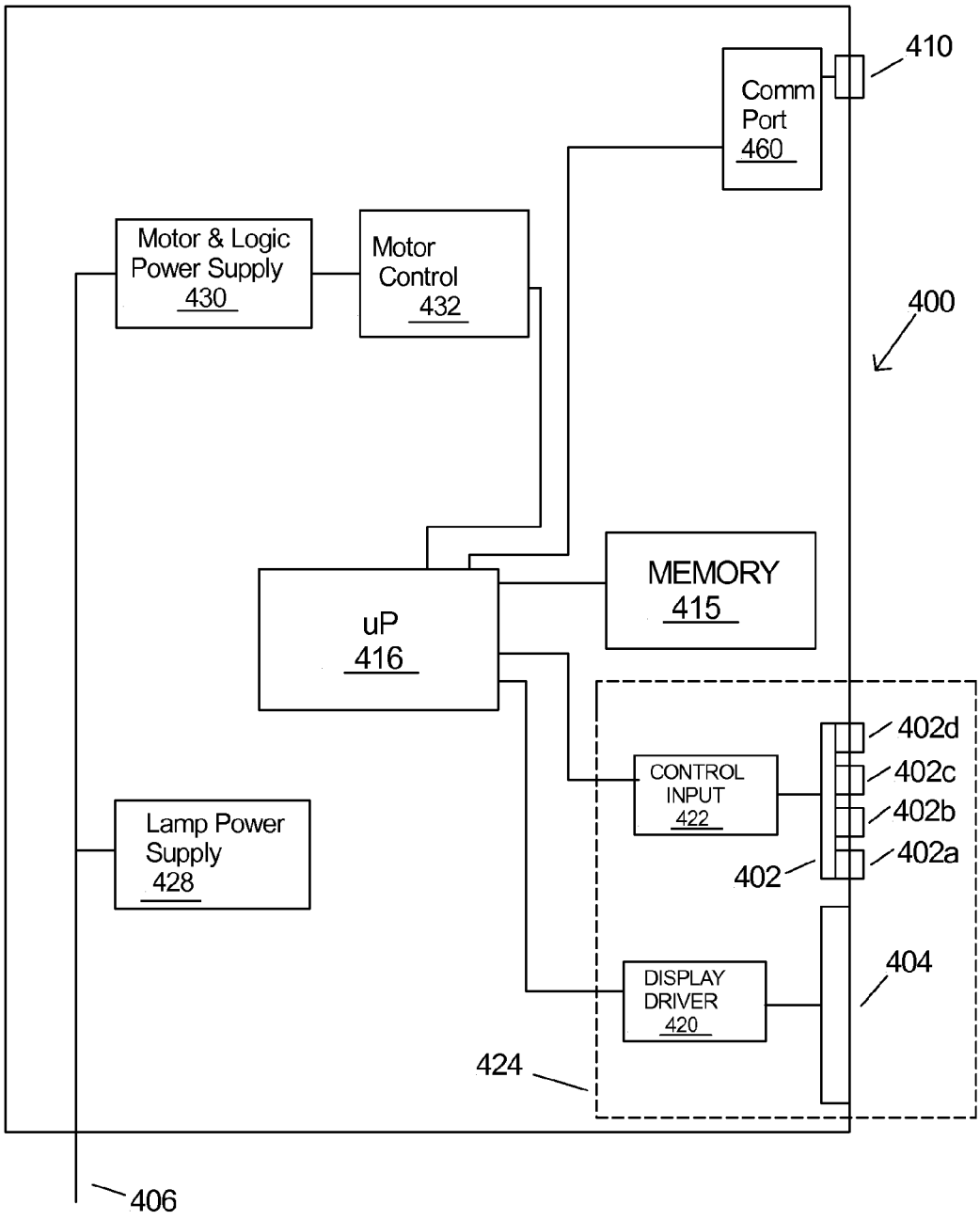
FIG. 4 shows an internal view of components of a base housing of the theatrical light of FIG. 1.

FIG. 4 shows a block diagram of the components of the base housing 400. Power is supplied to the base housing 400 through an input cable or cord 406. A lamp power supply 428 supplies power to the lamp 308 through wiring not shown for simplification. A motor and logic power supply 430 provides power to operate the electronics and motors such as motors 600*a*, 600*b*, 602, 604, 606 and 608 as well as pan and tilt motors not shown for simplification. A motor control system 432 provides the driving signals to the motors 600*a*, 600*b*, 602, 604, 606 and 608 as well as pan and tilt motors over wiring not shown for simplification. A communications port 460 receives commands via a connection point 410 to a standard theatrical communication system. A central controller as used in the art (not shown for simplification) compatible with the DMX theatrical protocol can send commands to the communication port 460 to alter the states of the lenticular homogenizing lens 230 and the prism apparatus 350. The communications port 460 can receive the DMX commands and the commands can be passed to a processing system, processor, or microprocessor 416 that works under control of an operating system stored in a memory 415. The processor may be programmed by the operating system and/or a computer program to execute functions in accordance with an embodiment of the present invention. A display 404 driven by a display driver 420 and input buttons 402*a*, 402*b*, 402*c* and 402*d* can be used by a technician to set a unique address for the theatrical light 100.

A first command received by the theatrical light 100 can change the position of the radial lenticular lens 230 in relation to the polymer Fresnel output lens 240 to zoom the light path exiting the theatrical light 100 from narrow to wide. A second command received by the theatrical light 100 can tilt in or out each of the radial lenticular lens 330 halves 330*a* and 330*b* to be in out of the light path like that shown in FIGS. 3B and 3C. A third command can place the prism apparatus 350 of FIG. 3C to be in or out of the light path of the light created by the lamp 308 and the reflector 310. A fourth command can change the position of the prism apparatus 350 in relation to the polymer fresnel output lens 240 to be closer or further away from the polymer fresnel output lens 340 of FIG. 3D to adjust the angular deviation of the second and third light paths created by the prism apparatus 350. A fifth command can cause the motor 604 to rotate the prism apparatus 350 in the path of light created by the lamp 308 and the reflector 310 to cause the second and third light paths to rotate about each other.

We claim:

1. A theatre lighting apparatus comprising:
a base;
a communications port;
a processor;
a memory;
a lamp housing;
the lamp housing comprising;
a lamp,
a reflector,
an output lens,
a motor,
and a homogenizing lens;
wherein the homogenizing lens is comprised of a plurality of radially arranged lenticular lenses;
and wherein the processor is programmed to enable a motor to vary a position of the homogenizing lens in relation to a position of the output lens.

2. The theatre lighting apparatus of claim 1
wherein the communications port receives a command, provides it to the processor, and the processor in response to the command is programmed to cause the motor to vary the position of the homogenizing lens in relation to the position of the output lens.

3. The theatre lighting apparatus of claim 1
wherein the output lens is a polymer fresnel lens.

4. A theatre lighting apparatus comprising:
a base;
a communications port;
a processor;
a memory;
a lamp housing;
the lamp housing comprising:
a lamp,
a reflector,
an output lens,
a motor, and
homogenizing lens; and
wherein a light path is created by the lamp and the reflector;

wherein the homogenizing lens is comprised of a first half and a second half, such that the first half is independent of the second half;

wherein each of the first half and the second half have a plurality of radially arranged lenticular lenses;

wherein the processor is programmed to cause a first motor to tilt the first half in or out of the light path; and wherein the processor is programmed to cause a second motor to tilt the second half in or out of the light path.

5. The theatre lighting apparatus of claim 4 wherein the processor is programmed to cause the first motor to tilt the first half into the light path in response to a first command received by the communications port and provided to the processor.

6. A theatre lighting apparatus comprising:

a base;

a communications port;

a processor;

a memory;

a lamp housing;

the lamp housing comprising;

a lamp, a reflector, an output lens, and an homogenizing lens;

wherein the homogenizing lens is comprised of a plurality of radially arranged lenticular lenses; and wherein the processor is programmed to cause a motor to vary a position of the homogenizing lens in relation to the reflector.

7. A theatre lighting apparatus comprising:

a base;

a communications port;

a processor;

a memory;

a lamp housing;

the lamp housing comprising;

a lamp, a reflector, an output lens, and a prism apparatus;

wherein a first light path having an optic axis is created by the lamp and the reflector;

wherein the prism apparatus is comprised of a plurality of substantially parallel linear triangular prisms;

wherein each of the plurality of prisms has a first side for receiving light from the first light path;

wherein each of the plurality of prisms has a second side for exiting refracted light received from the first light path towards a first direction forming a second light path;

wherein each of the plurality of prisms has a third side for exiting refracted light received from the first light path towards a second direction forming a third light path; and wherein the first direction and the second light path is at a substantially negative deviation angle in relation to the axis of the first light path and the second direction and third light path is at a substantially positive deviation angle in relation to the axis of the first light path.

8. The theatre lighting apparatus of claim 7 further comprising a motor; and wherein the processor is programmed to cause the motor to position the prism apparatus to a first position in relation to the output lens along the first light path to obtain a first deviation angle for the second light path and obtain a second deviation angle for the third light path.

9. The theatre lighting apparatus of claim 8 wherein the processor is programmed to cause the motor to position the prism apparatus to a second position in relation to the output lens along the first light path to obtain a third deviation angle for the second light path and obtain a fourth deviation angle for the third light path.

10. The theatre lighting apparatus of claim 7 wherein the deviation angles of the second light path and the third light path are remotely controlled by a command received by the communications port and provided to the processor.

11. A theatre lighting apparatus comprising:

a base;

a communications port;

a processor;

a memory;

a lamp housing;

the lamp housing comprising;

a lamp, a reflector, an output lens, a motor, and a prism apparatus having an axis;

wherein a first light path having an optic axis is created by the lamp and the reflector;

wherein the prism apparatus is comprised of a plurality of Isosceles prisms;

wherein each of the plurality of isosceles prisms has a first side for receiving light from the first light path; and wherein the processor is programmed to cause the motor to rotate the prism apparatus about the axis of the prism apparatus.

12. The theatre lighting apparatus of claim 8 wherein the processor is programmed to cause the motor to rotate the prism apparatus about the axis of the prism apparatus in response to a command received by the communication port and provided to the processor.

13. A theatre lighting apparatus comprising:

a base;

a communications port;

a processor;

a memory;

a lamp housing;

the lamp housing comprising:

a lamp, a reflector, an output lens, a motor, and a prism apparatus having an axis;

wherein a first light path having an optic axis is created by the lamp and the reflector;

wherein the prism apparatus is comprised of a plurality of Isosceles prisms;

wherein each of the plurality of isosceles prisms has a first side for receiving light from the first light path;

and wherein the processor is programmed to cause the motor to rotate the prism apparatus about the axis of the prism apparatus.

14. The theatre lighting apparatus of claim 13 wherein the processor is programmed to cause the motor to position the prism apparatus in relationship to the output lens along the first light path.

15. The theatre lighting apparatus of claim 14 wherein the processor is programmed to cause the motor to position the prism apparatus in relationship to the output lens along the first light path in response to a command received by the communication port and provided to the processor.

16. A method comprising:

varying a position of a homogenizing lens in relation to a position of an output lens;

wherein the homogenizing lens and the output lens are located in a theatre lighting apparatus which is further comprised of a base, a communications port, a processor, a memory, and a lamp housing, the lamp housing comprising a lamp, a reflector, the output lens, a motor, and the homogenizing lens; and wherein the homogenizing lens is comprised of a plurality of radially arranged lenticular lenses.

17. The method of claim 16 further comprising receiving a command at the communications port;

providing the command to the processor, and wherein the processor is programmed to cause the motor to vary the position of the homogenizing lens in relation to the position of the output lens in response to the command.

18. The method of claim 17 wherein the output lens is a polymer fresnel lens.

19. A method comprising tilting a first half of a homogenizing lens in or out of a light path; and tilting a second half of a homogenizing lens in or out of the light path;

wherein the homogenizing lens is comprised of the first half and the second half, such that the first half is independent of the second half;

wherein each of the first half and the second half have a plurality of radially arranged lenticular lenses; and wherein the homogenizing lens is located in a theatre lighting apparatus which further includes a lamp which creates the light path.

20. The method of claim 19 further comprising receiving a first command at a communications port of the theatre lighting apparatus;

and tilting the first half of the homogenizing lens into the light path in response to the first command.

21. A method comprising:

varying a position of a homogenizing lens in relation to a reflector in a theatre lighting apparatus; and wherein the homogenizing lens is comprised of a plurality of radially arranged lenticular lenses.

22. A method comprising positioning a prism apparatus to a first position in relation to an output lens in a theatre lighting apparatus;

wherein the theatre lighting apparatus includes a lamp which produces a first light path; and wherein the prism apparatus in the first position causes a second light path to have a first deviation angle from the first light path, and causes a third light path to have a second deviation angle from the first light path.

23. The method of claim 22 further comprising receiving a remote command at a communications port of the theatre lighting apparatus and positioning the prism apparatus in response to the remote command.

24. The method of claim 22 wherein the prism apparatus is comprised of a plurality of isosceles prisms;

and further comprising rotating the prism apparatus about an axis of the prism apparatus.

25. The method of claim 24 further comprising receiving a command at a communications port of the theatre lighting apparatus and rotating the prism apparatus about the axis of the prism apparatus in response to the command.

* * * * *